US009163398B2

(12) United States Patent
Varanasi et al.

(10) Patent No.: US 9,163,398 B2
(45) Date of Patent: Oct. 20, 2015

(54) SOUND BARRIER SYSTEMS

(71) Applicant: Purdue Research Foundation, West Lafayette, IN (US)

(72) Inventors: Satya Surya Srinivas Varanasi, West Lafayette, IN (US); Somesh Khandelwal, Sunnyvale, CA (US); Thomas Siegmund, West Lafayette, IN (US); John Stuart Bolton, West Lafayette, IN (US); Raymond J. Cipra, West Lafayette, IN (US)

(73) Assignee: PURDUE RESEARCH FOUNDATION, West Lafayette, IN (US)

( * ) Notice: Subject to any disclaimer, the term of this patent is extended or adjusted under 35 U.S.C. 154(b) by 0 days.

(21) Appl. No.: 14/281,408

(22) Filed: May 19, 2014

(65) Prior Publication Data

US 2014/0339014 A1 Nov. 20, 2014

Related U.S. Application Data

(60) Provisional application No. 61/824,387, filed on May 17, 2013.

(51) Int. Cl.

| | |
|---|---|
| ***G10K 11/172*** | (2006.01) |
| ***E04B 1/86*** | (2006.01) |
| ***G10K 11/168*** | (2006.01) |
| *E04B 1/74* | (2006.01) |

(52) U.S. Cl.

CPC ..... *E04B 1/86* (2013.01); *G10K 11/168* (2013.01); *E04B 2001/748* (2013.01)

(58) Field of Classification Search

CPC ..... G10K 11/172; E04N 1/82

USPC ..... 181/290, 284, 292

See application file for complete search history.

(56) References Cited

U.S. PATENT DOCUMENTS

| | | | | |
|---|---|---|---|---|
| 6,196,352 | B1 * | 3/2001 | Goodchild | 181/290 |
| 6,220,388 | B1 * | 4/2001 | Sanborn | 181/290 |
| 6,360,844 | B2 * | 3/2002 | Hogeboom et al. | 181/213 |
| 8,087,494 | B2 * | 1/2012 | Palumbo et al. | 181/290 |
| 8,573,358 | B2 * | 11/2013 | Nonogi et al. | 181/291 |
| 2005/0194209 | A1 * | 9/2005 | Yang et al. | 181/286 |
| 2006/0124388 | A1 * | 6/2006 | Pompei | 181/290 |
| 2009/0178882 | A1 * | 7/2009 | Johnson | 181/286 |
| 2011/0186380 | A1 * | 8/2011 | Beauvilain et al. | 181/292 |
| 2013/0209782 | A1 * | 8/2013 | Kipp et al. | 428/313.3 |
| 2014/0233781 | A1 * | 8/2014 | Kawakami et al. | 381/359 |

* cited by examiner

*Primary Examiner* — Forrest M Phillips

(74) *Attorney, Agent, or Firm* — Purdue Research Foundation

(57) ABSTRACT

A cellular material barrier system for reducing sound transmission. The cellular material system includes a planar cellular metamaterial arrangement which includes at least one unit cell, the unit cell includes a sound normalizing arrangement, and a planar metamaterial arrangement coupled to the sound normalizing arrangement on a first side, the planar metamaterial arrangement includes a plate, and a frame affixed to the plate, the sound normalizing arrangement configured to normalize incident sound received at non-normal angle to thereby convey sound at normal angles to the planar metamaterial arrangement, the unit cell further comprising a back layer that is coupled to the sound normalizing arrangement on a second side, opposite the first side, the back layer is made from a porous material, including at least one of a fibrous layer, polymeric foams, ceramic foams, and metallic foams.

25 Claims, 8 Drawing Sheets

SOUND BARRIER SYSTEMS

CROSS-REFERENCE TO RELATED APPLICATIONS

The present U.S. patent application is related to and claims the priority benefit of U.S. Provisional Patent Application Ser. No. 61/824,387, filed May 17, 2013, the contents of which are hereby incorporated by reference in its entirety into the present disclosure.

STATEMENT REGARDING GOVERNMENT FUNDING

This invention was made with government support under FA9550-09-1-0714 awarded by The U.S. Air Force Office of Scientific Research. The government has certain rights in the invention.

TECHNICAL FIELD

This application relates to systems, structures, materials and designs used as sound and noise barriers.

BACKGROUND

This section introduces aspects that may help facilitate a better understanding of the disclosure. Accordingly, these statements are to be read in this light and are not to be understood as admissions about what is or is not prior art.

Air-borne noise or unwanted sound is a side-effect of industrialization and the modern-day lifestyle. It has adverse effects on human health, both direct and indirect. While a long-term exposure to high levels of noise is found to cause auditory loss, increased noise level results in indirect effects, for example, sleep loss or increased blood pressure. Therefore, controlling and reducing noise levels is important. A major component of noise generated by household appliances, road traffic or industrial noise occurs in the frequency band of 20-4000 Hz. Noting that the human audible frequency range is 20 Hz to 20 kHz, this band is at the lower end of the audible frequency range. For purposes of this disclosure, low frequency band is defined to be ranging from 20 Hz to 4000 Hz.

Methods to control noise can be broadly grouped into (a) reducing the noise generated at source, (b) passive noise control, and (c) active noise control. Focusing on the passive control methods, the solutions are mainly based on two mechanisms, (1) reflection and (2) absorption. The solutions based on the reflection mechanism are referred to as sound barrier materials and those based on absorption are called sound absorbing materials. The performance of conventional sound barrier materials is in general governed by their inertia in the low frequency range, stiffness in the high frequency range, and by damping in the intermediate range defined by its characteristic coincidence frequency. The performance of the conventional barrier material in the inertia controlled region becomes poorer as the frequency is reduced. This situation necessitates high mass per unit area for effective noise reduction at low frequencies. For instance, to achieve a noise intensity reduction of 30 dB at 2100 Hz requires 5 $kg/m^2$, while a mass per unit area of 40 $kg/m^2$ is required at 300 Hz for the same level of reduction. This is undesirable as noise control at low frequencies imposes parasitic weight, cost and reduced portability.

Considering the sound absorbing materials, conventionally, porous materials are used to absorb the energy of the incident sound by dissipation into heat through the back and forth motion of the fluid carrying the sound wave in the pores. The challenge here is that these materials require large space to enable sizable energy absorption, particularly in the low frequency range. It was established that for maximum efficiency the porous material should be placed at approximately $\lambda/4$ distance from the surface of a backing wall and have a thickness greater than or equal to $\lambda/10$ ($\lambda$: wavelength of the sound wave of interest). For a sound wave at low frequencies, the wavelength is of the order of meters, and therefore the absorbing material needs large space which is again undesirable.

The design of lightweight passive treatments for noise barrier applications in the low frequency range has been a challenge due to the needed high mass per unit area. Thereby, blocking of low frequency sound has conventionally only been achieved by using relatively high masses, since alternative stiffness-based or dissipation-based solutions are usually ineffective in that frequency range for unsupported, homogeneous panels.

Accordingly, there is an unmet need for noise control solutions that address the challenges of designing lightweight barriers, particularly in low frequency ranges.

SUMMARY

A cellular material barrier system for reducing sound transmission is disclosed. The cellular material system includes a planar cellular metamaterial arrangement which includes at least one unit cell. The unit cell includes a sound normalizing arrangement. The unit cell further includes a planar metamaterial arrangement coupled to the sound normalizing arrangement on a first side. The planar metamaterial arrangement includes a plate, and a frame affixed to the plate. The sound normalizing arrangement configured to normalize incident sound received at non-normal angle to thereby convey sound at normal angles to the planar metamaterial arrangement. The unit cell further includes a back layer that is coupled to the sound normalizing arrangement on a second side, opposite the first side, the back layer is made from a porous material, including at least one of a fibrous layer, polymeric foams, ceramic foams, and metallic foams.

A method for improving sound transmission loss (STL) is also disclosed. The method includes placing a sound normalization arrangement about a space where improving STL is desired. The sound normalization layer is configured to normalize incident sound received at non-normal angles to thereby convey sound at normal angles. The method further includes coupling a planar metamaterial arrangement to the sound normalizing arrangement on a first side. The planar metamaterial arrangement includes a plate, and a frame affixed to the plate. The method further includes coupling a back layer to the sound normalizing arrangement on a second side, opposite the first side, the back layer is made from a porous material, including at least one of a fibrous layer, polymeric foams, ceramic foams, and metallic foams.

BRIEF DESCRIPTION OF DRAWINGS

While some of the figures shown herein may have been generated from scaled drawings or from photographs that are scalable, it is understood that such relative scaling within a figure are by way of example, and are not to be construed as limiting.

DETAILED DESCRIPTION

Figure 1A:
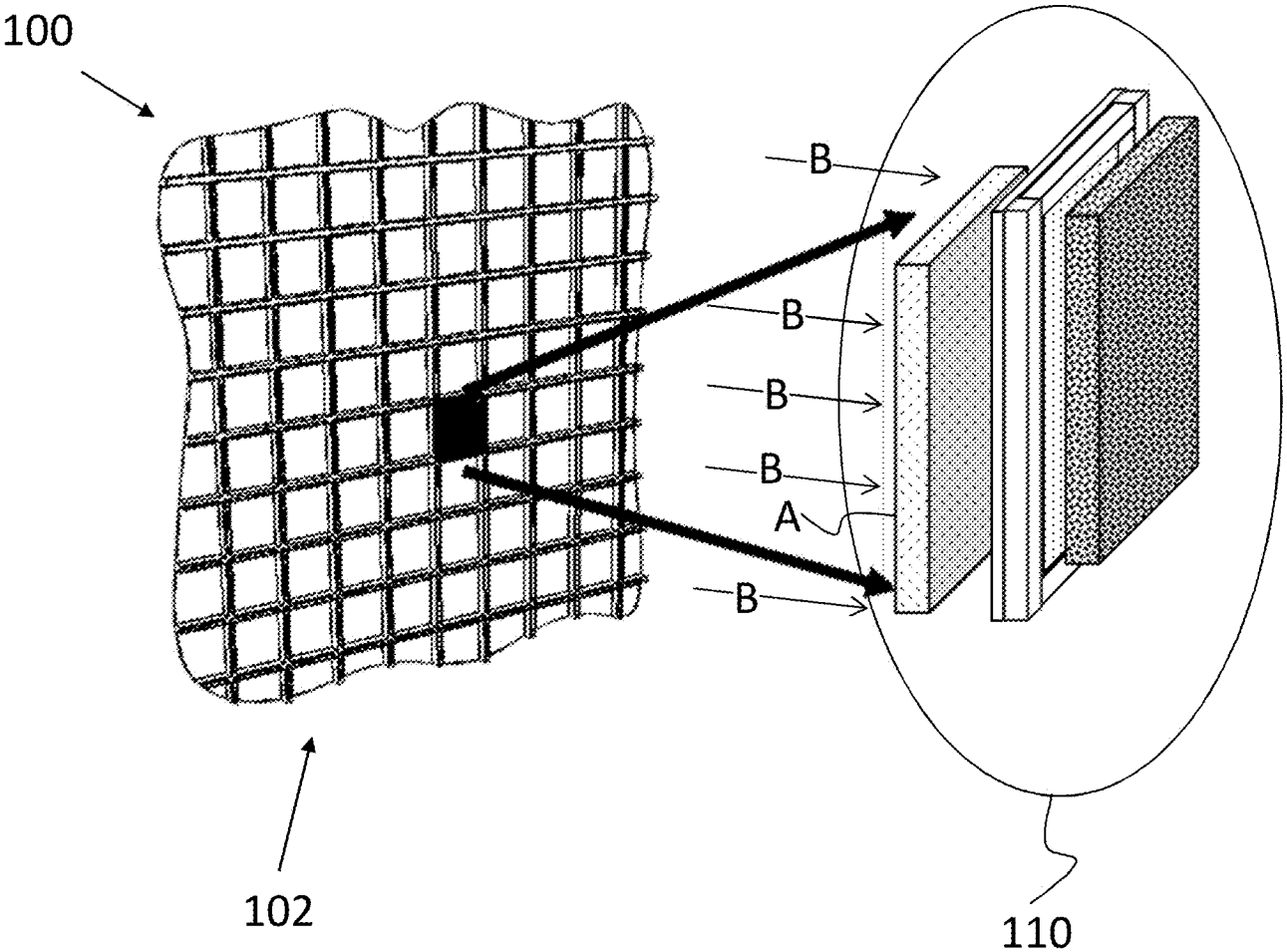
FIG. 1A is a schematic representation of a planar metamaterial panel including a plurality of unit cells, depicting direction of incident sound.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein being contemplated as would normally occur to one skilled in the art to which the disclosure relates.

In the present disclosure various embodiments of noise control systems are provided by incorporating sound barrier metamaterials. Metamaterials belong to a class of structures whose properties arise not only from the composition of the materials but significantly from the design and structural arrangement of the materials as deployed in a system. Local resonance in the system can be used to transfer and localize the incoming energy, in order to improve sound transmission loss (STL).

FIG. 1A is a schematic representation of a sound barrier system 100 including a panel 102 (also referred to as a planar cellular metamaterial arrangement), which includes a plurality of unit cells 110. The panel 102 is provided in a partial form, i.e., the boundaries of the panel 102 are not shown, as the majority of sound barrier properties are described with respect to one unit cell 110 of the panel 102. In addition, when the size of the panel 102 is substantially larger than the size of the unit cell 110, the size of the panel is less important in determining the sound transmission response. The unit cell 110 shown in FIG. 1A is an exemplary embodiment of the unit cells, and other embodiments of unit cells are described, herein. As shown in FIG. 1A, the unit cells 110 are provided in a lattice arrangement with dimensional repeatability. While equal sized rectangular unit cells 110 are shown in FIG. 1A, it should be appreciated that other polygon shapes and distributions of sizes can be used to form the panel 102. For example, a combination of pentagon-shaped unit cells or hexagon-shaped unit cells or other tessellation (i.e., flat tiling using one or more geometric shapes, with no overlaps and no gap) can form the lattice arrangement of the panel 102. Therefore, no limitation as to the shape or distribution of shapes of the unit cell 110 is intended. Also shown in FIG. 1A is the direction of the incident sound denoted by the arrows B onto a first side "A" of the unit cell 110.

Figure 1C:
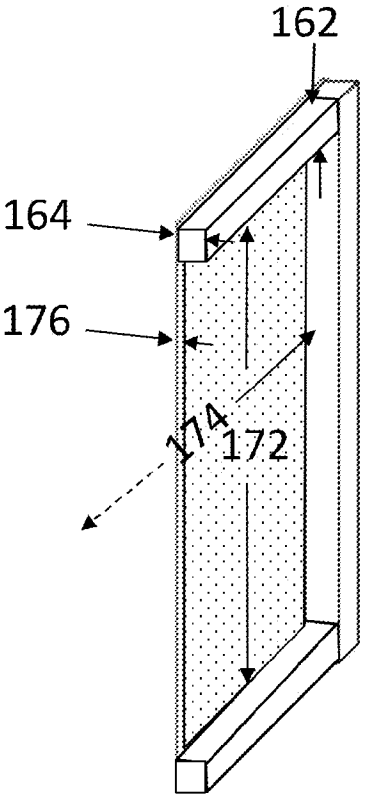
FIG. 1C is a partial perspective schematic view of the unit cell of FIG. 1B.
Figure 1B:
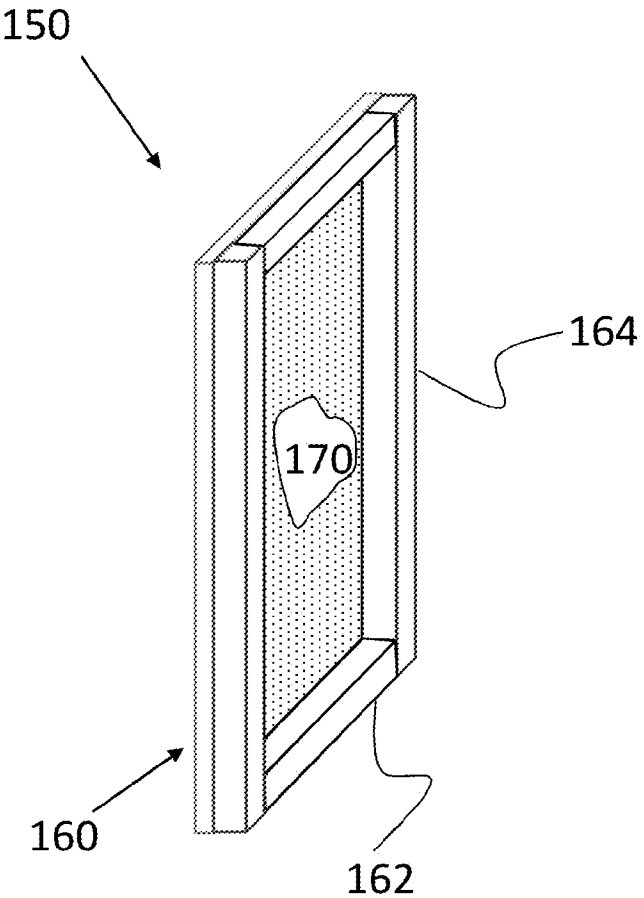
FIG. 1B is a schematic representation of one embodiment of a unit cell of FIG. 1A, including a planar metamaterial arrangement.

Referring to FIG. 1B, a planar metamaterial arrangement 150 is depicted. In each embodiment of the sound barrier system disclosed herein, a common planar cellular material arrangement, such as the arrangement 150, is integral to the embodiment, and which possesses sound attenuating properties as described herein. Each planar metamaterial arrangement 150 includes a frame 160 and a plate 170. The frame 160 can include various portions, e.g., width-wise portions 162, and length-wise portions 164, that are adhered to each other by welding, adhesive, or other interconnect arrangements such as dowel pins, or other arrangement known to a person having ordinary skill in the art. The arrangement 150 can also be made by machining from a monolithic piece, or by additive manufacturing. The arrangement 150 is depicted as a rectangular, however, as discussed above, other shapes may be possible, e.g., square, in which case dimensions 162 and 164 would be the same. In addition to the frame 160, the planar metamaterial arrangement 150 also includes the plate 170 which is coupled to the frame 160. The plate itself may be either homogeneous (i.e., possessing spatially uniform mass and stiffness properties) or inhomogeneous (i.e., having spatially non-uniform mass and stiffness properties). It is possible for the plate 170 to be affixed to the frame 160, or simply coupled to the frame 160 but allowed to deflect in a direction orthogonal to the plane of the lattice (which is formed by a plurality of the arrangement 150) in a planar manner with respect to the frame 160. It should be noted that the deflection of the plate 170 can be in phase or out of phase with the deflection of the frame 160. Furthermore, while the plate 170 is depicted as having its boundaries terminated at the frame 160, it should be understood that the plate 170 can be larger than the frame 160; for example, a sheet-like plate (not shown) can be used that is coupled to multiple neighboring frames 160.

Referring to FIG. 1C, a partial perspective schematic representation of the planar metamaterial arrangement 150 is depicted. The frame 160 is shown to have width of 162 and depth of 164. The frame 160 may be formed as a solid or a hollow body. The plate 170 is defined by its height 172, width 174, and thickness 176. Various geometric design parameters and the selection of material densities and elastic mechanical properties of the frame 160 and the plate 170 may dictate choices for these dimensions.

Planar metamaterial arrangement 150 including a frame 160 made from high density and high modulus material, surrounding a plate 170, provides significant increases in STL in a low-frequency range compared to a homogeneous solid of equal area mass in the form of a panel, called a limp panel.

The planar metamaterial arrangement 150 is constructed such that the ratio of mass of the frame to the mass of the plate is greater than one. Given the proper dimensions and material, described further below, the planar metamaterial arrangement 150 can be used to provide a large STL over a desired frequency range (e.g., see FIG. 5, and the description of FIG. 5, below). The desired transmission loss results from incident sound striking the planar metamaterial arrangement 150 and the planar metamaterial arrangement 150 reflecting a substantial portion of the incident sound back toward the source within a certain frequency range. It should be noted that the sound attenuation characteristics can be tuned for a desired frequency range by adjusting the size, the mass, and/or the elastic modulus of the frame and/or plate.

Example material and dimensions for the frame and plate of the planar metamaterial arrangement 150 are provided below. As one example, a metamaterial system can be considered to be made of PLEXIGLAS (Poly(methyl methacrylate): PMMA) for both frame and plate where the material density is 1100 kg/m3 and the elastic modulus of 3 GPa. For a planar metamaterial arrangement dimension of 63 mm by 63 mm, an interior plate dimension of 51 mm by 51 mm, a frame thickness of 12 mm and plate thickness of 1.8 mm, a target frequency range of 900-1500 Hz can be achieved.

For a panel as shown in FIG. 1A, having a unit cell such as the planar metamaterial arrangement 150 shown in FIG. 1B, a finite-element model of a single unit cell was used to predict the normal incidence transmission loss of the periodic array by imposing boundary conditions and accounting for the spatial periodicity of this arrangement. Such a cellular panel (not shown) can yield enhanced STL if the unit cell (i.e., as the planar metamaterial arrangement 150) mass is apportioned appropriately between the plate 170 (see FIG. 1B) and the frame 160. Two design strategies based on mass redistribution can be considered; material-based and geometry-based. In the material-based strategy, materials of the frame 160 and the plate 170 may be different. Accordingly, the densities of the materials used for the frame 160 and the plate 170 can be different ensuring that the ratio of the mass of frame 160 to the mass of plate 170 is greater than 1. The higher this mass ratio, the higher the STL. A preferred non-limiting range for this ratio can be 1-100.

Further, in one embodiment, the elastic modulus of the frame 160 can be higher than of the plate 170. According to one embodiment, a preferred but non-limiting range for this ratio for elastic modulus of the frame to the elastic modulus of the plate can range from 1 to 10.

In a geometry-based approach, the frame 160 and the plate 170 of each planar metamaterial arrangement 150 are made of same material but the thickness of the plate 170 (the thickness not shown) and thickness and the size of the frame 160 are different ensuring that the ratio of the mass of frame 160 to the mass of plate 170 is greater than 1. The higher this mass ratio, the higher the STL. A preferred non-limiting range for this ratio can be 1-100.

Figure 2B:
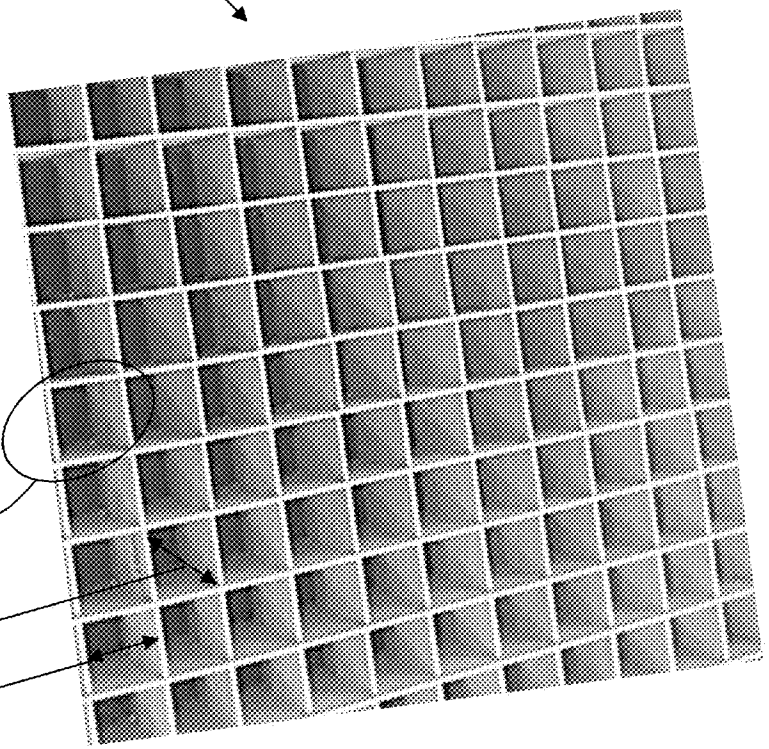
FIG. 2B is one embodiment of the sound normalization layer shown in FIG. 2A.
Figure 2A:
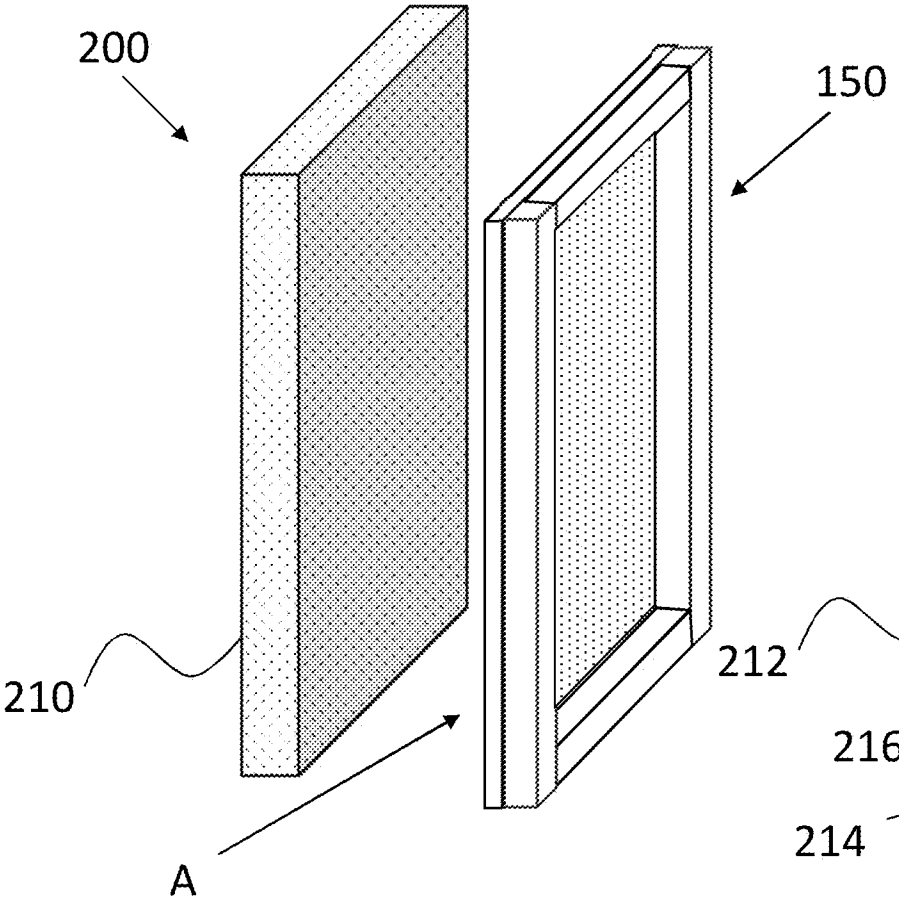
FIG. 2A is a schematic representation of one embodiment of a unit cell of FIG. 1A, including a sound normalization layer added to the unit cell of FIG. 1B.

While the planar metamaterial arrangement 150 shown in FIG. 1B has previously been shown to provide high STL for sound that strikes the arrangement at a normal angle, it has also been previously shown that the STL effectiveness of the planar metamaterial arrangement 150 is reduced when the incident sound does not strike the planar metamaterial arrangement 150 at a normal angle. To improve upon the planar metamaterial arrangement 150, a sound normalization layer is coupled to the plate of the planar metamaterial arrangement 150, as an embodiment of the unit cell 110 shown in FIG. 1A. Referring to FIG. 2A, this embodiment of the unit cell 200 is depicted. The unit cell 200 includes the planar metamaterial arrangement 150, (see FIG. 1B), and a sound normalizing layer 210 (also herein referred to as a sound normalizing arrangement). The sound normalizing layer 210 is depicted to be on side "A" of the planar metamaterial arrangement 150.

The sound normalization layer 210 can be a non-homogenous layer of material with, e.g., a honeycomb structure configured to normalize sound striking it at various angles. The shape and structure of the sound normalization layer 210 may vary depending on the range of frequencies that are to be applied to the associated sound barrier system. Referring to FIG. 2B, an exemplary structure 210' of the sound normalization layer is depicted. The structure 210' includes a plurality of cells 212, each cell having a length/width dimension 214 and a longitudinal dimension 216. These dimensions are so chosen so as to normalize non-normal incident sound for a particular frequency range. For example, when normalization of the sound field is desired for frequencies below 5000 Hz ($f_{max}$), the dimension 214 must be smaller than $c/2f_{max}$, where c is the speed of sound in air, and $f_{max}$ is the highest frequency in the desired frequency band. The speed of sound in air is 343 m/s at sea level. As a result, dimension 214 must be smaller than or at the most 3.43 cm. Therefore, a length/width dimension of about 3.43 cm ensures normalization of sound wave at non-normal angles through the sound normalization layer 210'. The cell 212 need not be limited to a rectangular shape with an in-plane aspect ratio of 1. It can have different aspect ratios and the shape can be different. In such cases, the longest dimension characterizing the shape must be less than $c/2f_{max}$.

Consequent to the sound normalization layer 210 or 210', the sound waves emerging from the sound normalization layer 210 or 210' and prior to striking the plate 170 of the planar metamaterial arrangement 150 (see FIG. 2A) will tend to be close to a normal angle of incidence.

In addition, the cells 212 of the sound normalization layer 210' can be filled with sound absorbing material, for example, but not limited to, a layer of glass fiber, a layer of mono or multicomponent polymeric blown micro-fiber, or a layer of fully or partially reticulated metallic, ceramic or polymeric foam, to also provide sound attenuation.

The embodiment depicted in FIG. 2A, is effective in first normalizing sound incident on the sound normalization layer 210, which conveys normalized sound to the planar metamaterial arrangement 150 where efficient STL is realized. This embodiment is considerably more effective than only utilizing the planar metamaterial arrangement 150, by advantageously utilizing the effectiveness of the planar metamaterial arrangement 150 when only normalized sound is incident upon it.

Figure 3:
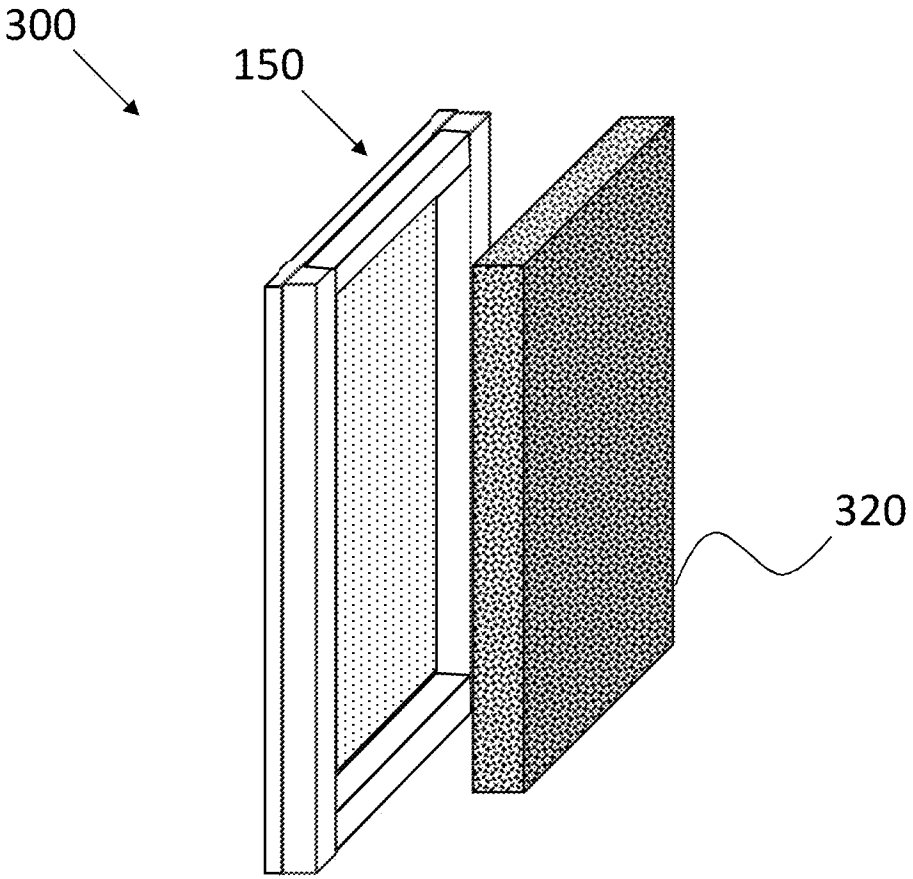
FIG. 3 is a schematic representation of one embodiment of a unit cell of FIG. 1A, including a sound attenuation layer added to the unit cell of FIG. 1B.

Referring to FIG. 3, another embodiment of the unit cell 300 which can be used as the unit cell 110 in FIG. 1A, is depicted. The unit cell 300 includes the planar metamaterial arrangement 150 that is coupled to a back layer 320. In the planar metamaterial arrangement 150, the relatively heavy frame constrains free motion of the plate and introduces a non-homogeneous mass distribution with the spatial distribution possessing a characteristic length scale. The sound transmission loss of the planar metamaterial arrangement 150 is strongly dominated by the constraint of the cellular panels by the surrounding frames, and by the resonance and anti-resonance response at the dominant eigenfrequencies of the cellular structure. The result is that the sound transmission loss of the planar metamaterial arrangement 150 is increased with respect to a homogeneous panel having the same mass per unit area, but only within a certain frequency range, i.e., near the anti-resonance. Typically, above the first anti-resonance frequency, a resonance of the cellular structure occurs which causes the STL of the structure to be reduced with respect to a homogeneous material of the same mass per unit area. Therefore, in order to maintain a high STL at frequencies higher than the anti-resonant frequency, a back layer 320 is provided. The back layer 320 is made of a porous material and acts efficiently at high frequencies, including the resonance frequency. Examples of such porous material include but are not limited to glass fibers, mono or multicomponent blown microfibers or polymeric, metallic or ceramic foams, or a combination of thereof. The embodiment depicted in FIG. 3, is effective in first providing an efficient STL with the planar metamaterial arrangement 150 and which provides further improved STL by the back layer 320. This embodiment is considerably more effective than only utilizing the planar metamaterial arrangement 150, by advantageously utilizing the effectiveness of the planar metamaterial arrangement 150 in combination with the sound attenuation of the back layer 320.

Figure 4:
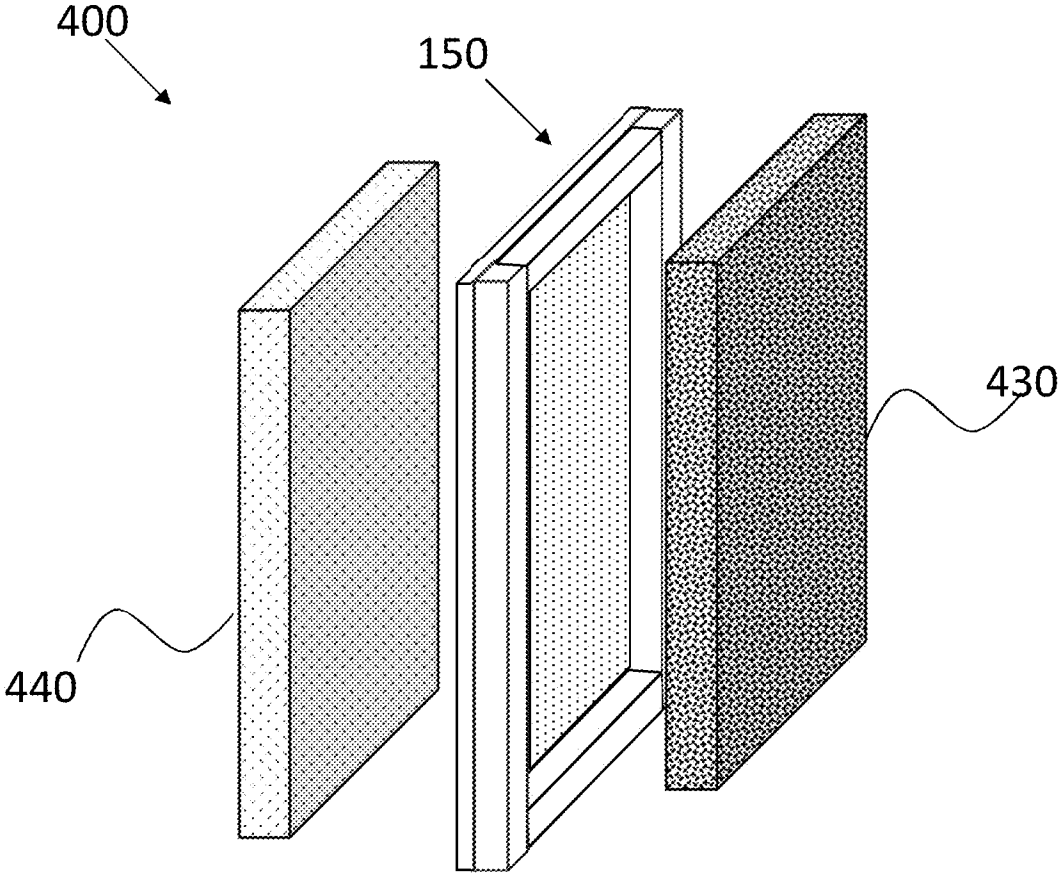
FIG. 4 is a schematic representation of one embodiment of a unit cell of FIG. 1A, including a sound normalization layer and a sound attenuation layer added to the unit cell of FIG. 1B.

Referring to FIG. 4, another embodiment of the unit cell 400 which can be used as the unit cell 110 in FIG. 1A, is depicted. The unit cell 400 includes the planar metamaterial arrangement 150, and it is coupled to a sound normalization layer 440 (see FIGS. 2A and 2B) and a back layer 430. The embodiment depicted in FIG. 4, is effective in first normalizing sound incident on the sound normalization layer 440, which conveys normalized sound to the planar metamaterial arrangement 150 where efficient STL is realized; and where the system is further optimized by placing a porous back layer 430 to absorb sound that was not properly reflected by the planar metamaterial arrangement 150. This embodiment is considerably more effective than only utilizing the planar metamaterial arrangement 150, by advantageously utilizing the effectiveness of the planar metamaterial arrangement 150 when only normalized sound is incident upon it, and in combination with the sound attenuation of the back layer 430.

While in the embodiments shown in FIGS. 1A through 4 one to several layers have been shown, culminating to three layers in FIG. 4, a multilayer system not limited to three layers is within the scope of this presentation.

Figure 5:
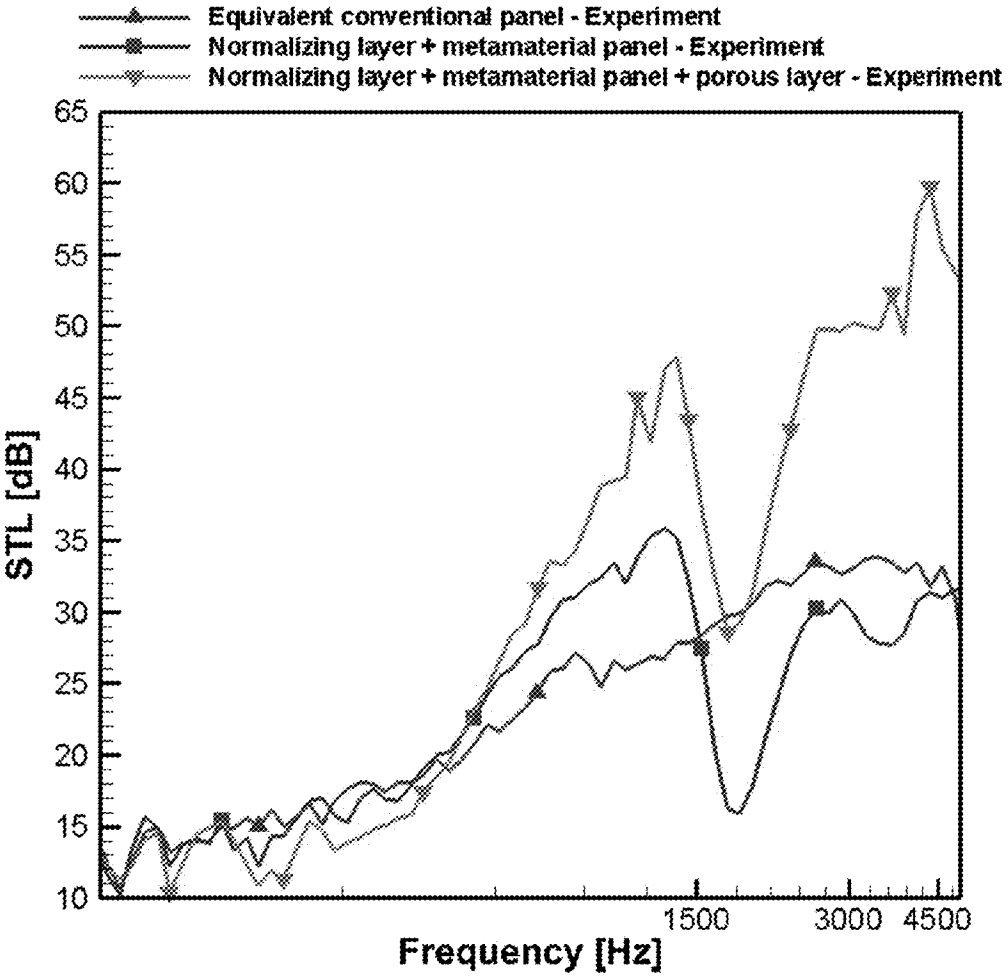
FIG. 5 is a graph of sound transmission loss (STL) in dB vs. frequency in Hz for a conventional panel (identified as Equivalent conventional panel), a metamaterial panel system shown in FIG. 2A (identified as Normalizing layer+metamaterial panel), and a metamaterial panel system including as shown in FIG. 4 (identified as Normalizing layer+metamaterial panel+porous layer).

Referring to FIG. 5, an exemplary representation of the performance of the embodiment in FIG. 4 illustrating the effect of the sound normalization layer 440 and the back layer 430 in combination with the planar metamaterial arrangement 150. The STL of the embodiment shown in FIG. 4 shows improved characteristics over a wide frequency range as compared to i) only utilizing a sound attenuation layer alone (identified as Equivalent conventional panel); and ii) utilizing a sound normalization layer in combination with a planar metamaterial arrangement (identified as Normalizing layer+metamaterial panel), according to the present disclosure. The data for the conventional panel was based on an areal mass of 6.14 kg/m$^2$. For equivalent comparisons, the planar metamaterial arrangement 150 and sound normalization and the back layer combination were designed to also have an approximately equal areal mass accounting. Therefore, while STL for the embodiment shown in FIG. 2A (identified as Normalizing layer+metamaterial panel) is advantageously above that of a conventional panel up to about 1500 Hz (the resonance frequency for the planar metamaterial arrangement 150), the STL for this embodiment begins to drop below the STL for the conventional panel at about 1500 Hz. However, by using the back layer 430 (see FIG. 4), the STL improves and goes higher than that of the corresponding conventional panel equivalent at frequencies above 1500 Hz while further improving the STL in the region of about 900-1500 Hz as compared to the embodiment associated with utilizing a sound normalization layer in combination with a planar metamaterial arrangement.

While the embodiments depicted in FIGS. 2A through 5 provide advantages over other systems in that these arrangements can be tuned to maximize STL for a desired bandwidth of frequencies and further normalize non-normal incident sound or absorb sound that is otherwise able to pass through the provided layers, there is no adjustability. In an alternative embodiment, the arrangement depicted in any of FIGS. 1A though 5 can be modified to provide an active system to change stiffness of the planar metamaterial arrangement 150 thereby providing a system that can adapt in real-time.

Figure 6:
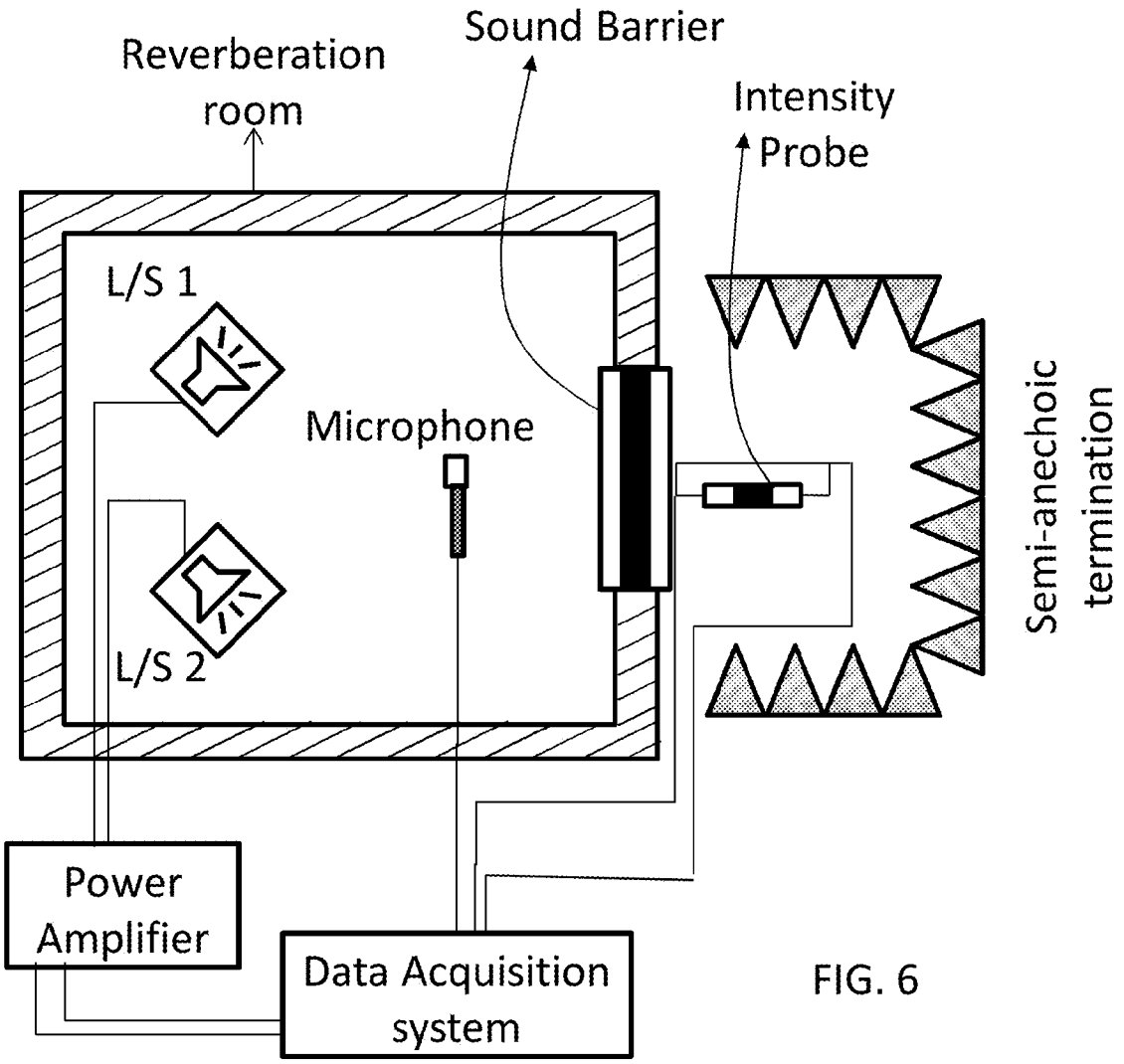
FIG. 6 is a schematic of the experimental setup where the metamaterial panel systems of the present disclosure were characterized, resulting in the graph provided in FIG. 5 based on a diffused sound field developed in a reverberation room setup.

Referring to FIG. 6, a schematic of the experimental setup is provided where the metamaterial panel systems of the present disclosure were characterized, resulting in the graph provided in FIG. 5 based on a diffused sound field developed in a reverberation room setup. The experimental setup includes a reverberation room as well as a semi-anechoic termination chamber. There are speakers placed in the reverberation room to generate sounds in order to evaluate various sound barrier systems according to the present disclosure. A microphone coupled to a data acquisition system is used to identify sounds on the incident side of these sound barrier systems. The data acquisition system amplifies signals to provide to the speakers. An intensity probe is coupled to the data acquisition system and is used to measure sound intensity that has been transmitted through the sound barrier system.

Figure 7:
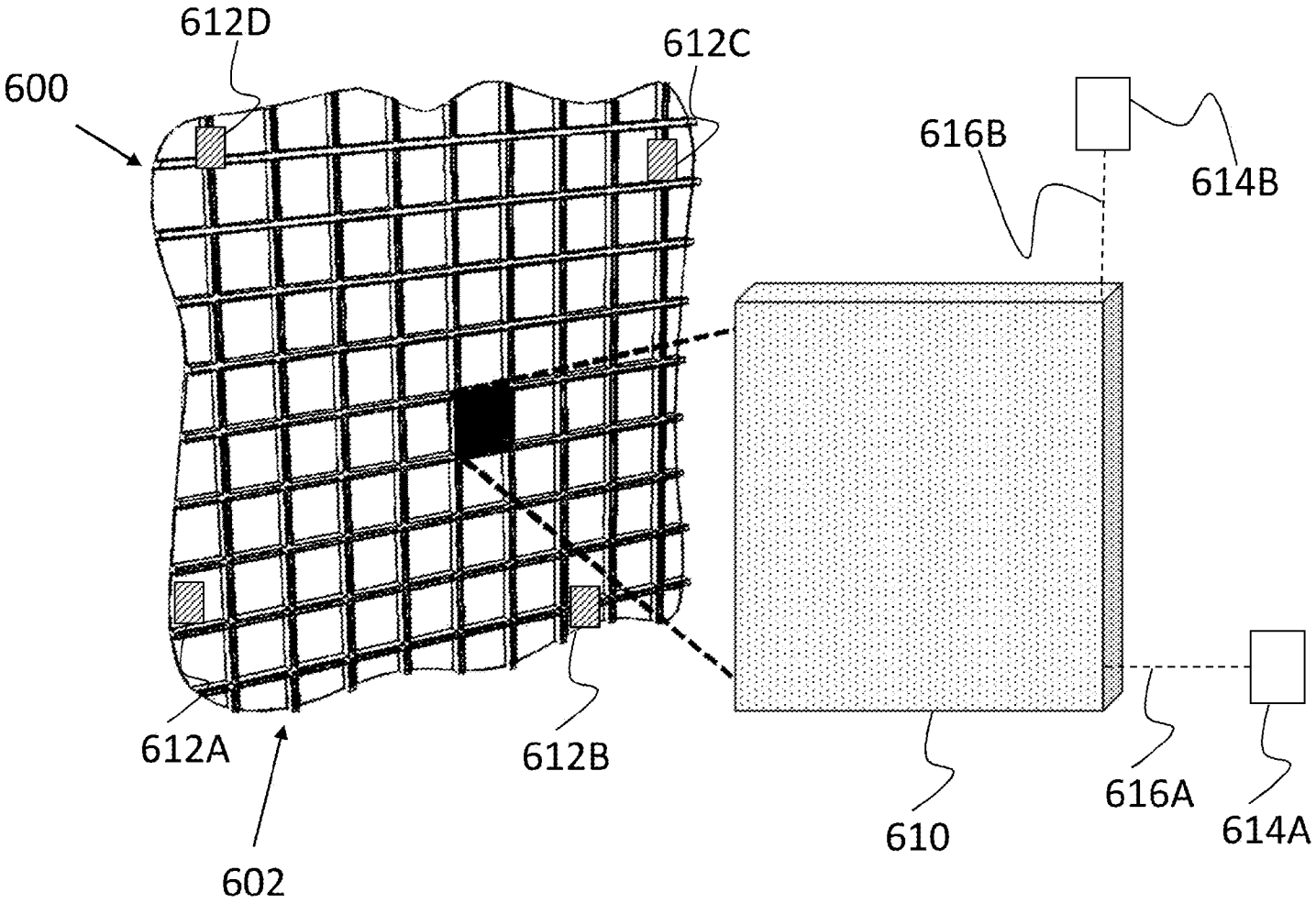
FIG. 7 is a schematic representation of an exemplary embodiment of an active sound barrier system according to the present disclosure.

Referring to FIG. 7, a schematic representation of a sound barrier system 600 including a panel 602, which includes a plurality of unit cells 610. The panel 602 is provided in a partial form, i.e., the boundaries of the panel 602 are not shown, as the majority of sound barrier properties are described with respect to one unit cell 610 of the panel 602. The unit cell 610 shown in FIG. 7 is thus depicted in general form, but can be any of the unit cell embodiments as shown and described in any of FIGS. 1B through 5.

The planar metamaterial arrangement 150 structures (e.g., frame 160 and plate 170, see FIG. 1B) which can be altered actively in its bending stiffness in response to a frequency of the dominant incident sound. A microphone 612A positioned, e.g., on the panel 602, is coupled to a sound analyzing microprocessor (not shown) which can control an actuator system including actuator(s) 614A(B) and linkage(s) 616A(B). For a differentially controlled system, more than one microphone, e.g., 612B-612D, can also be positioned in an interior space of the active acoustic system which can also be coupled to the sound analyzing microprocessor. The actuator system can be configured to change the stiffness of the unit cells 610 of the panel 602 by selectively placing the unit cells in a pre-stressed state. The actuator system can be configured to alter the flexural stiffness of the cell interior. The sound transmission loss of the core is strongly dominated by the resonance and anti-resonance response at the dominant eigenfrequency of the cellular structure. The result is that the sound transmission loss of the planar metamaterial arrangement is increased over a selected dominant frequency. In order to adapt to varying sounds and to maintain a high sound transmission loss throughout a wide frequency range, the resonance/antiresonance frequency is altered by actively altering the flexural stiffness of the unit cell frame 160 or the plate 170. To that end, the cell interior or plate is constructed as a topologically interlocked material for which mechanical constraint can be used to alter its flexural stiffness. The change in stiffness is triggered by a signal from a microphone embedded in the sound barrier, processed for dominant frequency by the microprocessor. Following the signal, an actuator (pneumatically or otherwise) can be used to alter the constraint on the topologically interlocked material, resulting in the adaptive change of the dominant sound barrier.

Various approaches can be implemented to obtain the desired flexural stiffness for the sound attenuation system. For example, special electrically-sensitive cables can be threaded through the material in a matrix form (e.g., up-down, and side-to-side) in a topologically interlocked system. Other ways of altering stiffness are also encompassed herein, as would be known to a person having ordinary skill in the art. The lengths of these cables can then be adjusted by applying a current to the cable in order to place the desired stiffness on the material. Alternatively, the edges (e.g., two edges) of the material can be fixed by plates that are moveable and thereby configured to place a desired load on the material. In either of these examples, sensors can be utilized to measure the amount of load that is being placed on the material and adjust the load according to the desired results.

While this disclosure illustrates several embodiments of sound barrier systems, it should be noted that many other embodiments can be generated by those skilled in the art, based on the concepts and embodiments described here. For example, the periodic lattice of the sound attenuation layer can be based on other unit cell geometries. Further, it is possible to have several different types of unit cells integrated into the lattice structure of sound attenuation layers. Further it should be noted that while planar panels are shown, it is within the scope of this disclosure to have curved panels configured to conform to curved surfaces.

While the present disclosure has been described with reference to certain embodiments, it will be apparent to those of ordinary skill in the art that other embodiments and implementations are possible that are within the scope of the present disclosure without departing from the spirit and scope of the present disclosure. It is therefore intended that the foregoing detailed description be regarded as illustrative rather than limiting. Thus this disclosure is limited only by the following claims.

The invention claimed is:

1. A cellular material barrier system for reducing sound transmission comprising:

a planar cellular metamaterial arrangement, including at least one unit cell, the unit cell including a sound normalizing arrangement; and a planar metamaterial arrangement coupled to the sound normalizing arrangement on a first side, the planar metamaterial arrangement including a plate, and a frame affixed to the plate, the sound normalizing arrangement configured to normalize incident sound received at non-normal angles to thereby convey sound at normal angles to the planar metamaterial arrangement.

2. The cellular material barrier system of claim 1, the sound normalizing arrangement comprises a lattice structure having a plurality of sound normalizing cells, the plurality of sound normalizing cells configured to normalize incident sound for a frequency range.

3. The cellular material barrier system of claim 2, the frequency range between 1 and 4,000 Hz.

4. The cellular material barrier system of claim 2, the frequency range between 1 and 10,000 Hz.

5. The cellular material barrier system of claim 3, each cell of the plurality of sound normalizing cells having a polygon shape with a depth of at least about 2 mm.

6. The cellular material barrier system of claim 2, the sound normalizing arrangement made from a low sound speed porous material.

7. The cellular material barrier system of claim 2, the sound normalizing arrangement made from wood.

8. The cellular material barrier system of claim 2, the sound normalizing arrangement made from at least one of a composite, polymeric, and metallic materials.

9. The cellular material barrier system of claim 8, a sub-plurality of the plurality of sound normalizing cells filled with porous sound absorbing material.

10. The cellular material barrier system of claim 1, the unit cell further comprising a back layer coupled to the sound normalizing arrangement on a second side, opposite the first side, the back layer made from a porous material, including at least one of a fibrous layer, polymeric foams, ceramic foams, and metallic foams.

11. The cellular material barrier system of claim 10, the porous material includes glass fibers with mass density of less than about 30 $kg/m^3$.

12. The cellular material barrier system of claim 1, wherein ratio of mass of the frame and mass of the plate is between about 1 to about 100.

13. The cellular material barrier system of claim 1, wherein ratio of elastic modulus of the frame material to elastic modulus of the plate material is between about 1 to about 100.

14. A method for improving sound transmission loss (STL), comprising:

placing a sound normalization arrangement about a space where improving STL is desired, the sound normalization layer configured to normalize incident sound received at non-normal angles to thereby convey sound at normal angles; and coupling a planar metamaterial arrangement to the sound normalizing arrangement on a first side, the planar metamaterial arrangement including a plate, and a frame affixed to the plate.

15. The method of claim 14, the sound normalizing arrangement comprises a lattice structure having a plurality of sound normalizing cells, the plurality of sound normalizing cells configured to normalize incident sound for a frequency range.

16. The method of claim 15, the frequency range between 1 and 4,000 Hz.

17. The method of claim 15, the frequency range between 1 and 10,000 Hz.

18. The method of claim 16, each cell of the plurality of sound normalizing cells having a polygon shape with a depth of at least about 2 mm.

19. The method of claim 14, the sound normalizing arrangement made from a low sound speed porous material.

20. The method of claim 15, the sound normalizing arrangement made from a composite material.

21. The method of claim 20, a sub-plurality of the plurality of sound normalizing cells filled with porous sound absorbing material.

22. The method of claim 14, further comprising coupling a back layer to the sound normalizing arrangement on a second side, opposite the first side, the back layer made from a porous material, including at least one of a fibrous layer, polymeric foams, ceramic foams, and metallic foams.

23. The method of claim 22, the porous material includes glass fibers with mass density of less than about 30 $kg/m^3$.

24. The method of claim 14, wherein ratio of mass of the frame and mass of the plate is between about 1 to about 100.

25. The method of claim 14, wherein ratio of elastic modulus of the frame material to elastic modulus of the plate material is between about 1 to about 100.

* * * * *